US008282360B2

(12) United States Patent
Di Leo

(10) Patent No.: US 8,282,360 B2
(45) Date of Patent: Oct. 9, 2012

(54) PNEUMATICALLY OPERATED RECIPROCATING PUMP

(76) Inventor: Aldo Di Leo, Catania (IT)

( * ) Notice: Subject to any disclaimer, the term of this patent is extended or adjusted under 35 U.S.C. 154(b) by 478 days.

(21) Appl. No.: 12/498,880

(22) Filed: Jul. 7, 2009

(65) Prior Publication Data

US 2011/0008188 A1 Jan. 13, 2011

(51) Int. Cl.
*F04B 49/00* (2006.01)

(52) U.S. Cl. ..... 417/46; 417/9; 417/20; 417/32; 417/395

(58) Field of Classification Search ..... 417/392, 417/395, 382, 284, 286, 388, 9, 12, 20, 32, 417/43, 46, 454, 234; 92/112.2, 328–329; 91/48

See application file for complete search history.

(56) References Cited

U.S. PATENT DOCUMENTS 4,817,503 A * 4/1989 Yamada ..... 92/98 R
4,983,104 A * 1/1991 Kingsford et al. ..... 417/473
5,147,182 A * 9/1992 Timmons ..... 417/234
5,252,041 A * 10/1993 Schumack ..... 417/395
5,558,506 A 9/1996 Simmons et al.
5,593,289 A * 1/1997 Tarpley ..... 417/454
5,893,707 A * 4/1999 Simmons et al. ..... 417/393
6,168,394 B1 * 1/2001 Forman et al. ..... 417/395
2003/0012668 A1 1/2003 Simmons et al.
2007/0092386 A1 * 4/2007 Reed et al. ..... 417/395

* cited by examiner

*Primary Examiner* — Devon Kramer
*Assistant Examiner* — Ryan Gatzemeyer

(57) ABSTRACT

A pneumatically operated reciprocating pump comprises two opposed pumping chambers, in each one of which a respective flexible bellow slides under the control of a pneumatically operated shuttle valve capable to alternatively let a gaseous fluid in one of the two chambers for expanding the respective flexible bellow, each one of the two chambers being connected to at least one respective suction valve and to at least one respective delivery valve. Each delivery valve is provided with a compensating elastic means capable to compensate variations of rate of fluid that is pumped by the respective chamber. The pneumatically operated shuttle valve comprises a shaped spool sliding between two limit positions within a perforated cylinder, which shuttle valve is connected, for each chamber, to one or more delivery ducts and to one or more ducts for respectively letting and discharging gaseous fluid in and from the respective chamber.

43 Claims, 14 Drawing Sheets

PNEUMATICALLY OPERATED RECIPROCATING PUMP

The present invention relates to a pneumatically operated reciprocating pump that allows, in a simple, reliable, efficient, precise, and inexpensive way, to move fluids, in particular ultrapure fluids, maintaining constant pressure and rate with a positive or negative output offset value close to zero, the pump being mechanically rugged, chemically and universally resistant to etching by acids, solvents and ultrapure fluids such as DI water, and resistant at high temperatures, preferably up to 220° C. The pump is further controlled through a continuous and reliable monitoring, and easily maintainable.

Pneumatically operated reciprocating pumps are very well known in fluid industry. Such pumps usually comprise two pumping chambers, in each one of which a respective flexible bellow slides operating as pumping element, and they are operated by an exchanger that moves pressurized air from one pumping chamber to another when the flexible bellows reach the end of the stroke. The exchanger is provided with an internal spool moving between two positions which alternatively supply the pumping element of a side of the pump with pressurized air simultaneously allowing the other side to expel the air. The movement of the exchanger spool simply alternates the pressurized air and the one to be expelled between the two bellows inside the pump, consequently creating the reciprocating operation of the pump.

U.S. Pat. Nos. 5,558,506, 5,893,707 and US Patent Application No. US 2003/0012668 disclose three of such pneumatically operated reciprocating pumps.

Such pumps are largely used for pumping several types of fluids including water, chemical substances, alimentary substances, and other materials.

However, pneumatically operated reciprocating pumps of the prior art suffer from a number of drawbacks.

First of all, they are often made according to complex designs which hinder disassembly and reassembly of the pump, sometimes making usual maintenance and overhauling operations difficult.

Also, most bellow pumps of the prior art include small metal parts which, in some applications, could be chemically etched. By way of example, when these pumps are used in manufacturing processes in semiconductors factories, they operate in presence of corrosive fluids which chemically etch metals. In order to obviate this problem, some or all the parts which normally get in touch with the fluid (i.e. the wetted parts of the pump) are formed or covered with chemically inert materials, typically of plastic. These pumps often use some metal parts only in external (i.e. not wetted) location, as connections for maintaining the pump body and related pipes assembled with each other, exploiting the fact that the metal is more mechanically resistant and more easily machinable than chemically inert materials. However, also these pumps with only external metal parts, which are normally not in contact with fluids, have manifest problems in application to semiconductor industry. In fact, it is impossible to completely avoid leakages from a pump, whereby small amounts of leaked chemical products unavoidably get in contact with the external metal parts. When this occurs, metal parts corrode and the dissolved corroded particles could dissolve within the pump and contaminate the system. In this case, even small contaminating amounts may be disastrous: failures of chips due to contamination are typically not determined until chips are tested after manufacture is completed. In these circumstances, a single source of metal dissolving in a process fluid may cause a great economical loss, due to both lowering of percentage of operating manufactured chips and long interruption periods of the concerned production line necessary to determine contamination sources and to repair and purify the same production line.

A further drawback from which the pneumatically operated reciprocating pumps of the prior art suffer is due to the difficulty, particularly significant in applications with ultrapure fluids, in controlling and regularizing fluid rate. This problem is due to the same principle of operation of this type of pumps, and in particular to the cyclic movement of pumping membranes or bellows. Irregularity of pulsating flow that is typical of this type of pumps, besides constituting a disturbance factor for the process supported by the pump, may also create drawbacks of contamination in fluids. In order to obviate to such drawback, main manufacturing company allows optional tanks to be connected to the pump circuit which tanks act as shot compensators, which attenuate the irregularity of the delivery fluid rate. However, this regularizing action is not directly related to a measurement of the irregularity of flow and implies adoption of additional external components.

A further drawback is that of managing and controlling pump operation parameters and of monitoring the main components subject to wear. Presently, main manufacturers provide the adoption of optional devices for detecting fluid leakages within the air side, which may indicate flaw or yield of critical components, such as for instance the pumping bellows. In general, use of optical fibers suitably treated for being capable to operate in critical conditions is preferred especially when pumps operate with corrosive fluids. However, such control device are not sufficiently reliable, most of all in case of applications of pumps to semiconductor technology.

Hence, it is an object of the present invention to provide a pneumatically operated reciprocating pump that allows, in a simple, reliable, efficient, precise, and inexpensive way, to regulate rate and pressure of the pump with delivery offset values close to zero.

It is still an object of the present invention to provide such a pump that is easily maintainable, mechanically rugged, and resistant to etching by acids and solvents and to high temperatures.

It is a further object of the present invention to provide such a pump that is controllable through a continuous and reliable monitoring.

It is therefore specific subject matter of this invention a pneumatically operated reciprocating pump comprising two opposed pumping chambers, in each one of which a respective flexible bellow slides between a compressed position and an expanded position, a slide of the two flexible bellows being controlled by shuttle means capable to alternatively let a gaseous fluid in one of the two chambers for expanding the respective flexible bellow, whereby when each one of the two flexible bellows assumes a threshold expanded position it interacts with mechanical means allowing the gaseous fluid to be discharged from the respective chamber, each one of the two flexible bellows having a front end in contact with a shaft that is alternatively pushed by one of the two flexible bellows thus compressing the other, each one of the two chambers being connected to at least one respective suction valve and to at least one respective delivery valve, wherein each delivery valve is provided with compensating elastic means capable to compensate variations of rate of fluid that is pumped by the respective chamber.

Always according to the invention, said compensating elastic means may comprise at least one compensating bellow.

Still according to the invention, each compensating bellow may comprise a plurality of outer coils, separated from each other by a plurality of inner coils, wherein the inner and outer coils have a squared side profile.

Furthermore according to the invention, each delivery valve may be a ball valve.

Always according to the invention, each delivery ball valve may be housed in a respective seat of the pump closed by a tap, each delivery ball valve comprising a case housing a ball, the respective compensating bellow being interposed between the ball and the tap, so that, during pump operation, a front end of the compensating bellow gets in contact with the ball absorbing related impacts and pressure peaks exerted by the fluid pumped by the respective chamber.

Still according to the invention, each suction valve may be a ball valve.

Furthermore according to the invention, each suction ball valve may be housed in a respective seat of the pump closed by a tap, each suction ball valve comprising a case housing a ball and being closed by a cover.

Always according to the invention, the case and the tap of each delivery ball valve and the case and the cover of each suction ball valve may be shaped so as to be provided with three pockets, whereby a corresponding tool provided with three corresponding projections is allowed to insert therein and engage with them.

Still according to the invention, each one of the two flexible bellows may comprise a plurality of outer coils, separated from each other by a plurality of inner coils, wherein the outer and inner coils have a lateral profile that presents concave grooves.

Furthermore according to the invention, said shuttle means may comprise a pneumatically operated shuttle valve comprising a shaped spool sliding between two limit positions within a perforated cylinder, which shuttle valve is connected, for each chamber, to one or more delivery ducts and to one or more ducts for respectively letting and discharging gaseous fluid in and from the respective chamber, the shuttle valve being capable to alternatively open and close the delivery ducts of the two chambers depending on the position of the spool, the spool being moved by the gaseous fluid coming from a chamber through the respective discharge ducts when it is in a position in which it opens the delivery ducts of the other chamber.

Always according to the invention, for each chamber, said one or more delivery ducts and said one or more discharge ducts may be internal to the shuttle valve and to a head covering the respective chamber, the two heads being removably coupled to a pump body, the shuttle valve being fastened to the two heads through hollow screws provided with at least one duct capable to put at least one duct internal to the shuttle valve in communication with at least one duct of the respective head.

Still according to the invention, each one of the two heads and the pump body may be provided with mechanical means for mutual alignment.

Furthermore according to the invention, said mutual alignment mechanical means may comprise, for each head, at least one centering pin insertable in a through hole of the respective head and in a corresponding hole of the pump body.

Always according to the invention, said shuttle means may comprise control electronic means, that controls an electric shuttle connected, for each chamber, to one or more delivery ducts letting gaseous fluid in the respective chamber, the electric shuttle being capable to alternatively open and close the delivery ducts of the two chambers.

Still according to the invention, the electric shuttle may receive the gaseous fluid to alternatively let in the two chambers from a pressure regulator.

Furthermore according to the invention, said control electronic means may comprise at least one timer and a power supply.

Always according to the invention, said control electronic means may further control a pneumatically operated valve, installed on a delivery pipeline of the pump after a flow sensor capable to sense the pressure of the fluid pumped in the delivery pipeline and to send a related sensing signal to said control electronic means.

Still according to the invention, said control electronic means may comprise an electric valve controlling the pneumatically operated valve.

Furthermore according to the invention, the electric shuttle may be a five-way coil electric shuttle a power supply of which is controlled by said control electronic means.

Always according to the invention, the pump may comprise a control electronic unit that receives a signal indicative of the flow of the pumped fluid from a flow sensor mounted on a delivery pipeline of the pump, the control electronic unit controlling an electronic pressure regulator mounted on the compressed air delivery pipeline before said shuttle means depending on a predetermined flow value of the pumped fluid.

Still according to the invention, the control electronic unit may comprise a Programmable Logic Controller or PLC.

Furthermore according to the invention, the control electronic unit may be connected to interface means.

Always according to the invention, said interface means may comprise a display and a keyboard, preferably integrated in a touch-screen display.

Still according to the invention, said predetermined flow value of the pumped fluid may be adjustable.

Furthermore according to the invention, the control electronic unit may be connected, for at least one flexible bellow, to at least one first, preferably optical fiber, sensor internal to the pump capable to provide the control electronic unit with at least one detection signal when said at least one flexible bellow assumes a position within the respective chamber.

Always according to the invention, the control electronic unit may be capable to determine, and preferably to store, a number of cycles performed by the pump of said at least one detection signal.

Still according to the invention, the control electronic unit may be capable to program and signal interventions of preventive maintenance.

Furthermore according to the invention, the control electronic unit may be connected to one or more second, preferably optical fiber, sensors for sensing losses in the gaseous fluid circuit, capable to provide the control electronic unit with at least one signal of detection of presence of pumped fluid.

Always according to the invention, the electronic unit may be connected to one or more third sensors capable to provide the control electronic unit with at least one signal of detection of rate and/or pressure and/or temperature of the pumped fluid.

Still according to the invention, the pump may comprise a removable handle.

Furthermore according to the invention, the pump may be made of a material resistant to corrosion and/or chemical etching, preferably a material comprising one or more materials selected from the group comprising ultrapure thermoplastic materials, organic polymers, and fluoridated polymers, more preferably a material comprising one or more materials selected from the group comprising MFA, TFM, PP, Teflon PFA, pure Teflon, PEEK, PTFE, PVDF, and FEP.

The pump according to the present invention is a reciprocating pump provided with bellows, comprising compensating delivery valves and provided with a system for controlling and monitoring data through a series of sensors, that allows a whole control of the functionalities of the same pump. The compressed air (or the nitrogen) has the function of providing the pneumatically operated shuttle with energy, which shuttle operates the pumping bellows working within two chambers thus causing ultrapure fluids to move.

The bellow reciprocating pump according to the invention, pneumatically or electro-pneumatically controlled, is devoid of metal parts, and it is wholly made of corrosion resistant materials, so that it may be used with acids and corrosive fluids.

Moreover, particular constructive adjustments of the pump components permit to obtain an easily inspectable, mechanically rugged, universally resistant to etching by acids and solvents and at high temperatures, preferably up to 220° C.

According to another aspect of the invention, the pump is controlled by a system for controlling and monitoring data that provides a whole picture of the operation state of the main critical components (suction and delivery valves, bellows, pneumatically operated shuttle), e.g. signaling possible flaw of membranes or bellows due to wear, and it detects during operation the main flow parameters such as rate, pressure, temperature, whole number of the operation cycles. Preferably, such monitoring system comprises a display for displaying information on the pump operation state, on the basis of which the operators may schedule maintenance interventions.

Moreover, according to another aspect of the invention, the pump comprises a pair of compensating valves capable to regulate pump rate and pressure with delivery offset values close to zero, avoiding the use of conventional shot compensators mounted after the pumping system. In this way, the pump is more compact and the circuit after the same is simplified. Also, this allows to avoid the possibility of producing particles which could potentially be generated along the section going from the delivery valves up to the external compensator.

The present invention will be now described, by way of illustration and not by way of limitation, according to its preferred embodiments, by particularly referring to the Figures of the enclosed drawings, in which.

In the Figures, alike elements are indicated by same reference numbers.

Figure 1:
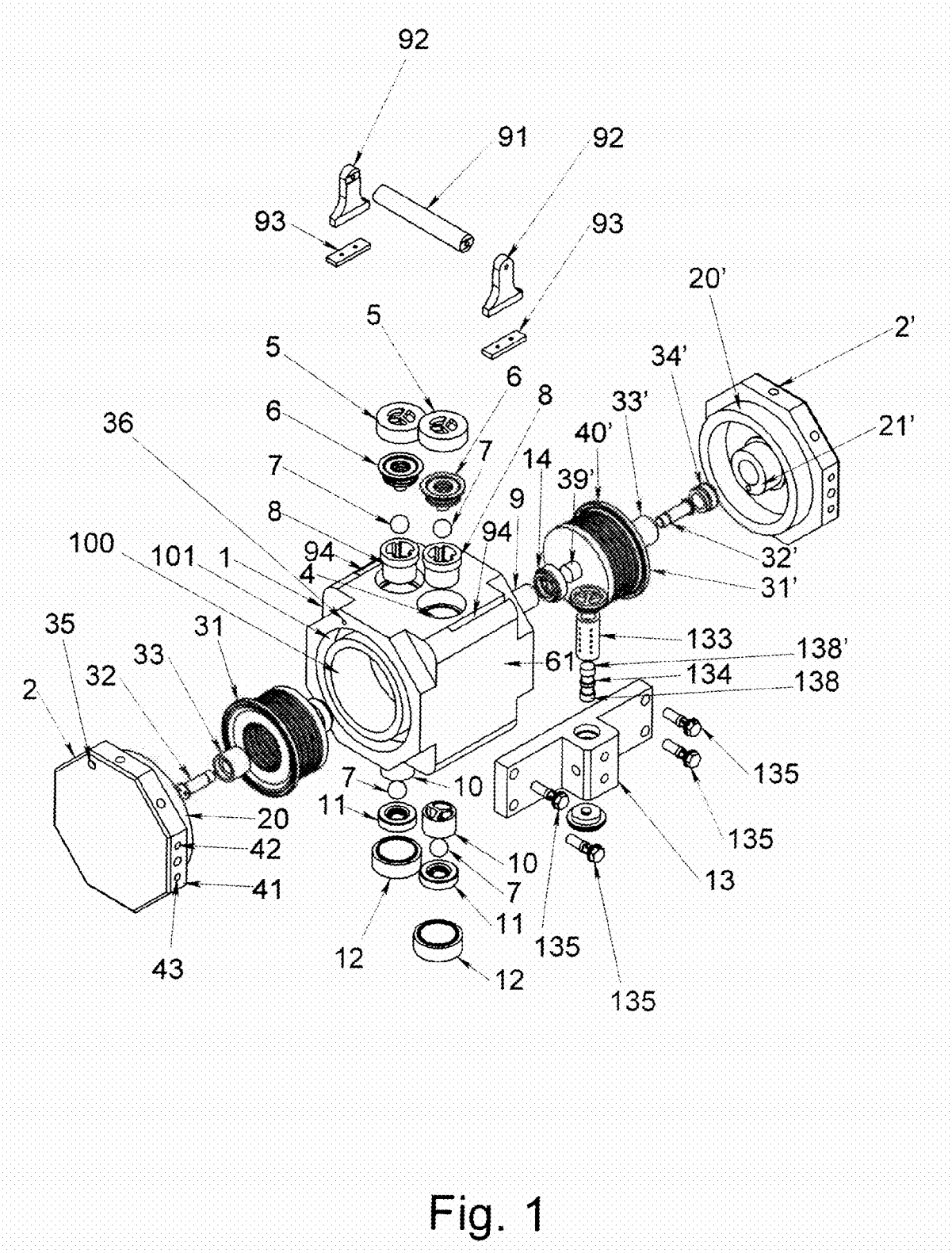
FIG. 1 shows an exploded view of the preferred embodiment of the pump according to the invention.
Figure 2:
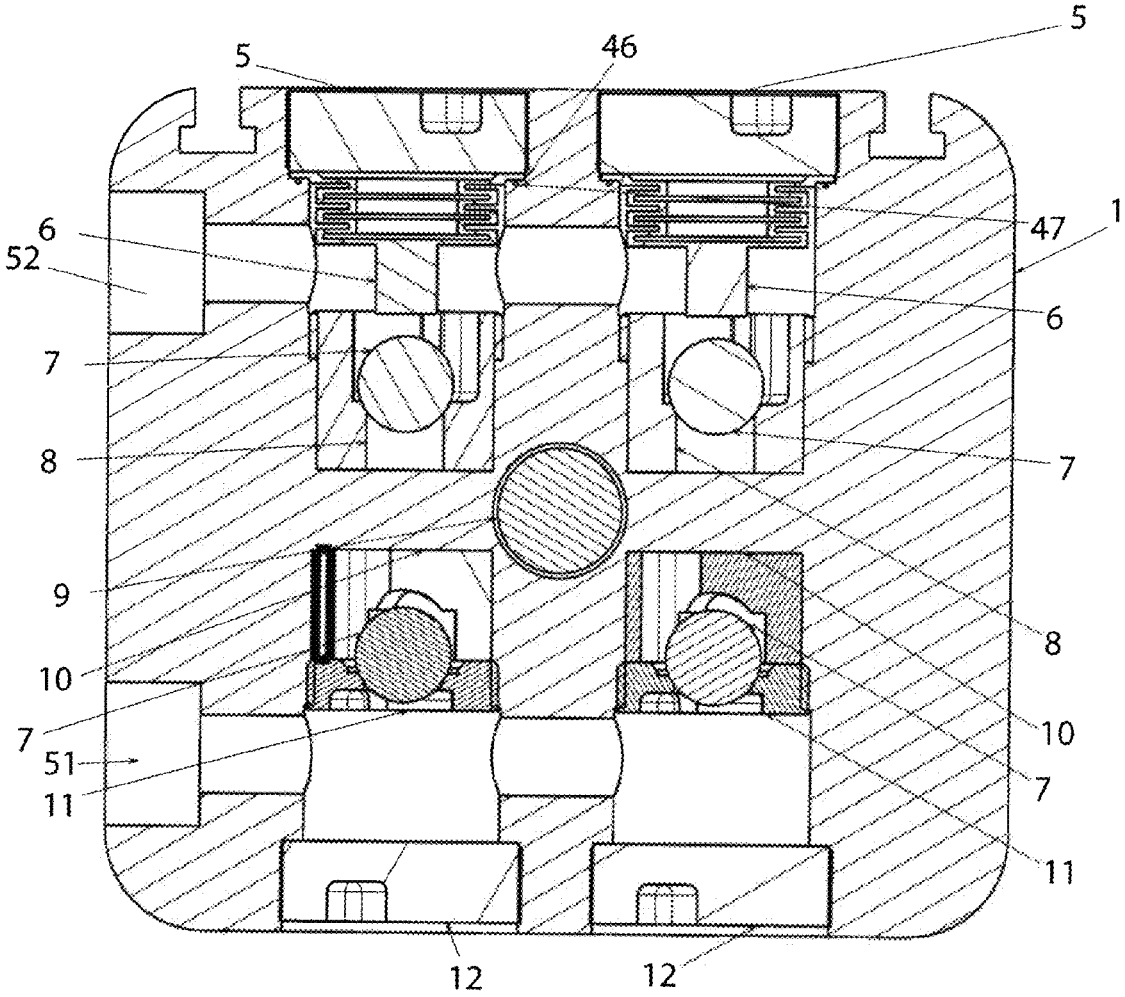
FIG. 2 shows a section of the body of the pump of FIG. 1 along a vertical plane passing through the compensating valves.

FIGS. 1 and 2 show the preferred embodiment of the pneumatically operated reciprocating pump according to the invention, comprising a central body 1, two opposed pumping chambers 100 (only one of which is visible in FIG. 1) are formed in correspondence of two opposed sides of the body, in each one of which chambers equivalent pumping components are housed. These include a pumping bellow 31 (and 31'), integrally coupled to a respective plunger 32 (and 32') on which a cylindrical element 33 (and 33'), in turn attached to a respective seal cap (34'), freely slides.

The reciprocating motion of the bellows 31 (and 31') activates pumping a fluid similarly to what disclosed in US Patent No. U.S. Pat. No. 5,893,707, . in respect to which the pump according to the present invention has a simplified assembly system consisting in having made the cylindrical element 33 (and 33') provided with a respective cap (34').

The fastening of each one of the pumping bellows 31 and 31' is carried out through a respective, preferably octagonal, head 2 (and 2') covering the pump, that is screwed in a gap 101 of the pump body 1 through two threads (not shown in the Figure) present on an inner circular projection 20 (and 20') of the head 2 (and 2') engaging corresponding threads, preferably customized with triangular profile, present on the walls of the gap 101. The reciprocating motion of the pumping chambers is carried out thanks to the horizontal slide of a shaft 9 alternatively pushed by a thrust nose of the pumping bellows 31 and 31' (thrust nose 39' of the bellow 31' is visible in FIG. 1).

In particular, the reciprocating motion of the pumping bellows 31 (and 31') is caused by pressurized air (or nitrogen) that is alternatively supplied to the two pumping chambers for pushing the respective bellow 31 (and 31'). During compression phase, movement of bellows 31 and 31' and plungers 32 and 32' drags caps 34 and 34' from their seats (located on the respective pump head 2 or 2') and it contributes to routing the pressurized air through opening and closing corresponding ducts connected to a shuttle valve 13, assembled outside the pump body 1. A spool 134 slides within the shuttle valve 13 which spool is moved by the air entering the circuit of such ducts starting from the same shuttle valve 13 and returning to the latter leaving the circuit. Depending on its position, the spool 134 alternatively opens and closes the ducts for supplying compressed air in the two pumping chambers.

As it will be illustrated below, the shuttle valve 13 is directly connected to the air supply and discharge ducts of the two pumping chambers so as to form a single body, without external connections or ducts. In particular, the heads 2 and 2' incorporate some ducts along which compressed air flows from and to the shuttle valve 13.

With reference to FIGS. 3-6, the air transmission circuit, and its operation, is now illustrated that allows the pump to alternate the suction and delivery phases between one pumping chamber and another.

Figure 3:
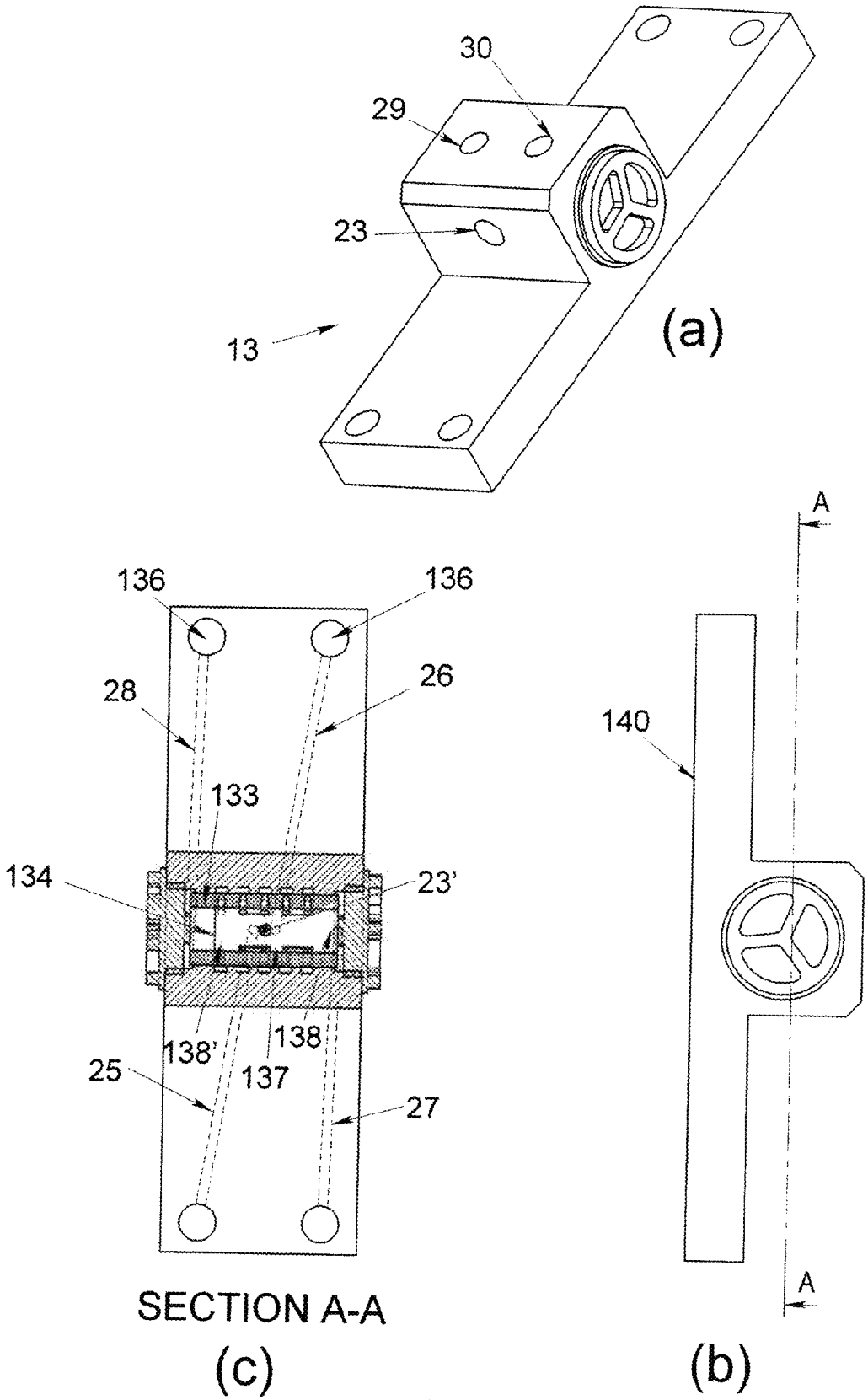
FIG. 3 shows a perspective view (a), a side view (b) and a sectional view (c) along line A-A of FIG. 3(*b*) of the shuttle valve of the pump of FIG. 1.

FIG. 3 shows the shuttle valve 13 (the inner ducts of which are visible in dashed lines in FIG. 3*c*), made of chemically inert material, preferably thermoplastic material like PFA Teflon and/or pure Teflon and/or PEEK. The shuttle valve 13 is provided with a duct 23, communicating with the outside, as inlet of the compressed air (or nitrogen) to the pump duct circuit. In FIG. 3*c*, . the reference numeral 23' indicates the position corresponding to the inner mouth of the duct 23. The cylindrical spool 134 is present within the valve 13 which spool alternatively slides within a perforated cylinder 133 switching between charge and discharge of the supply air (or nitrogen) to a first and a second duct 25 and 26, internal to the valve 13, which supply air to the pumping chambers (in particular, the duct 25 supplies air to the chamber 100 of FIG. 1). To this end, the cylindrical spool 134 is properly shaped, being provided with a central projection 137 that, depending on the position of the spool 134, operates as charge-discharge switch of the two ducts 25 and 26 (in the position of FIG. 3*c* the central projection closes the second duct 26). A third and a fourth ducts 27 and 28, still internal to the valve 13, transmits the air returning from the pumping chambers inside the cylinder 133, which, exerting a pressure on a respective end 138 (or 138') of the spool 134, causes the reversal of the position of the latter. To this end, the ends 138 and 138' of the cylindrical spool 134 have the same diameter of the central projection 137, so as not to let air coming from ducts 27 and 28 flow along the side walls of the spool 134. Finally, two outlet ducts 29 and 30, communicating with the outside, operates as air discharge after the spool 134 has been moved (by the air coming from ducts 28 and 27, respectively) up to respective limit positions.

Figure 4:
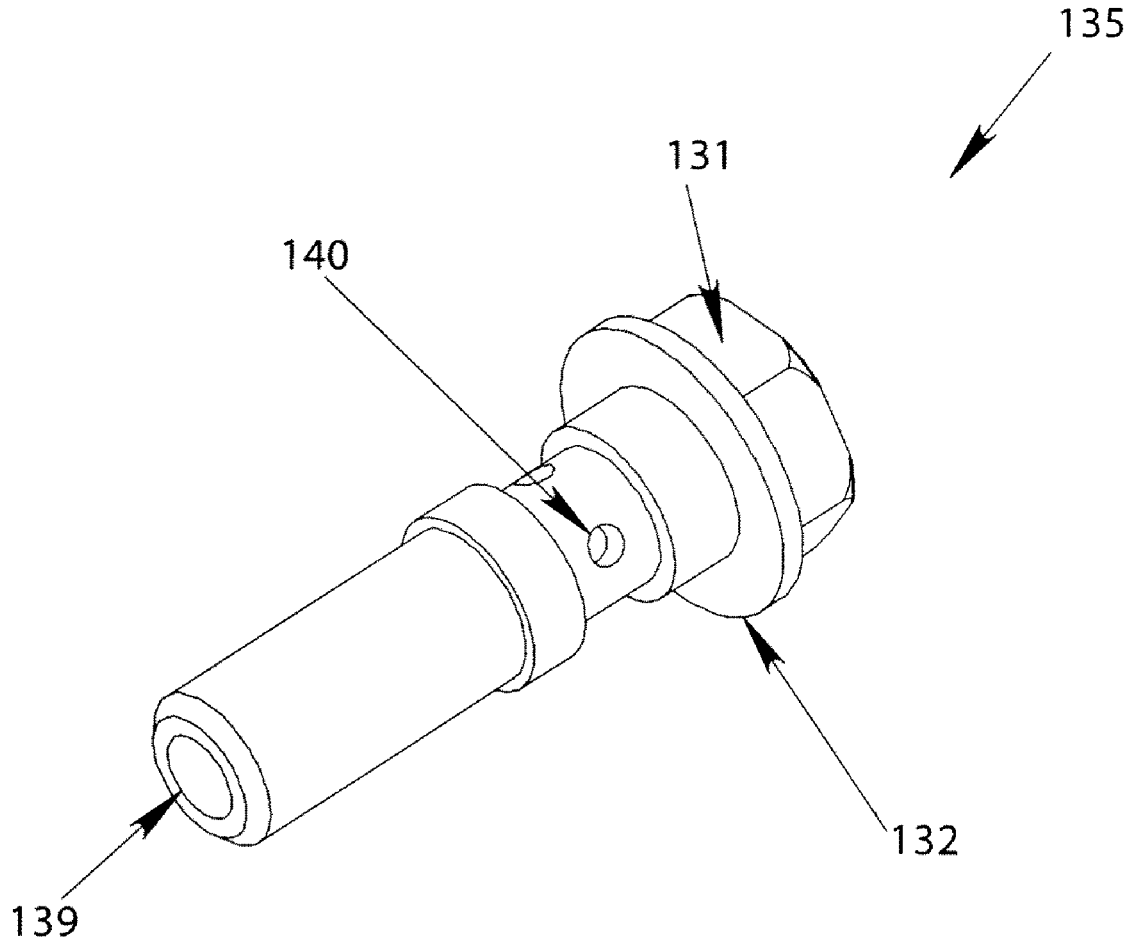
FIG. 4 shows a perspective view of a fastening screw of the shuttle valve of FIG. 3 to the pump of FIG. 1.

FIG. 4 shows a screw 135 fastening the shuttle valve 13 to the pump heads 2 and 2'. It may be observed that the screw 135 is provided, under its, preferably hexagonal, head 131, with a disc 132 of larger diameter than the hole 136 of the valve 13, so that, once the screw 135 is engaged into the hole 136 and is tightened into a corresponding hole present on the heads 2 and 2' (holes 42 and 43 on the head 2 are shown in FIG. 1), the latter is completely closed. Teflon ORs may be also placed between the shuttle valve 13 and the heads 2 and 2' for improving seal and alignment of the shuttle valve 13. In particular, the four fastening screws 135 of the shuttle valve 13 are integral part of the compressed air duct circuit. To this end, each screw 135 comprises an inner duct 139, for the passage of air along the direction towards the head 2 and 2', and holes 140 distributed along a collar located below the head 131, which put the inner duct 139 in communication with one of the inner ducts of the shuttle valve 13. Hence, the screws 135 perform a double function: a function of air distribution between the heads 2 and 2' and the shuttle valve 13, and a function of fastening the shuttle valve 13 to the heads 2 and 2'.

Figure 5:
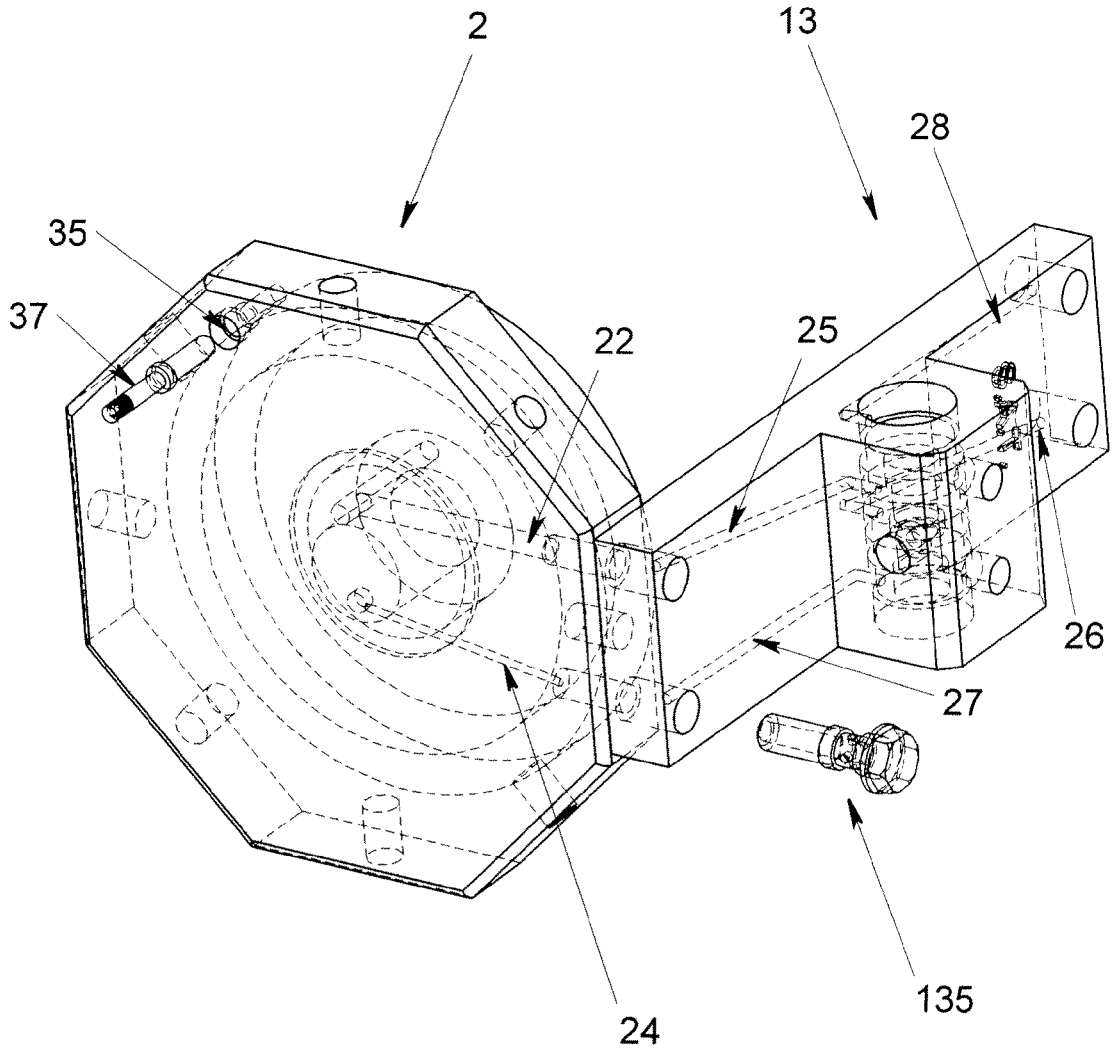
FIG. 5 shows a perspective view of the shuttle valve in the position of fastening to a covering head of the pump of FIG. 1.
Figure 6A:
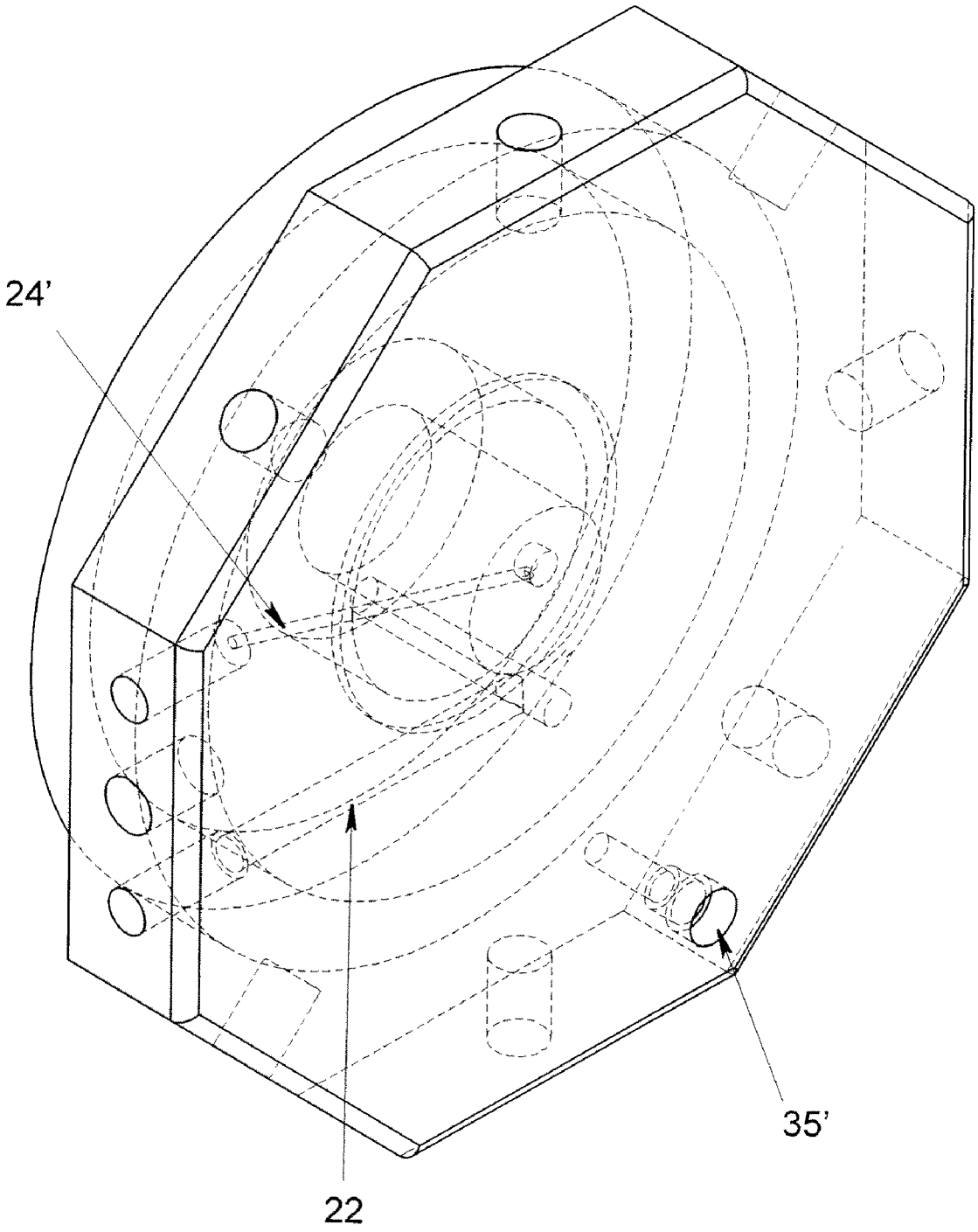
FIG. 6 shows a perspective view (a), a top plan view (b) and a bottom plan view (c) of a covering head of the pump of FIG. 1.
Figure 6C:
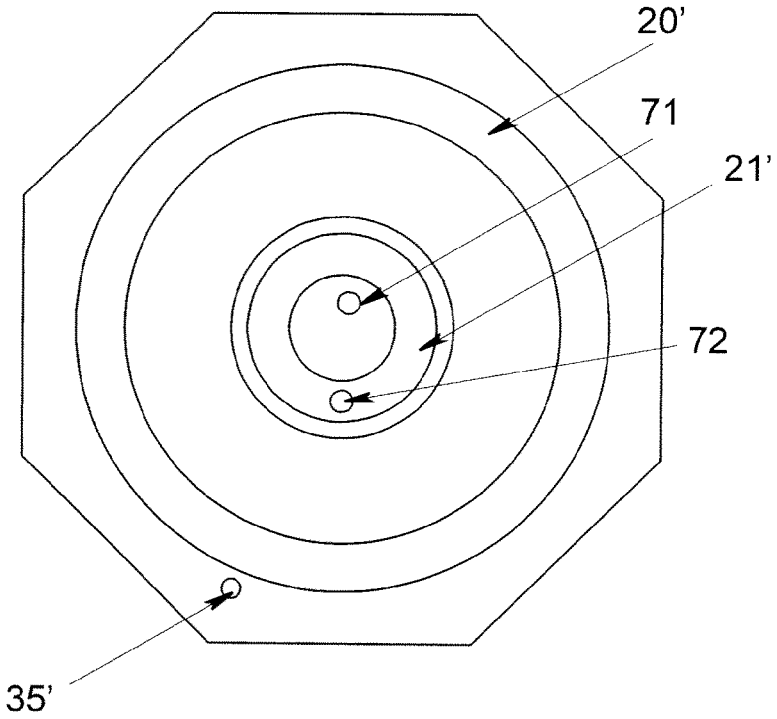
Figure 6B:
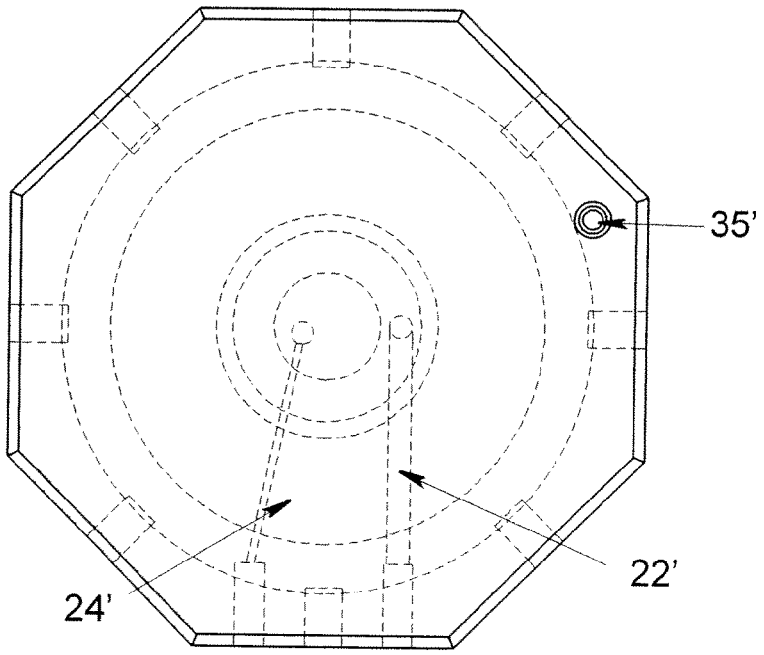

As schematically shown in FIG. 5, wherein the ducts internal to the shuttle valve 13, to the only shown screw 135, and to the head 2 are illustrated in dashed lines, the inner ducts 139 of the four screws 135 put the ducts 25-28 of the shuttle valve 13 in communication with corresponding two pairs of ducts internal to the heads 2 and 2'. In particular, FIG. 5 shows in the head 2 a fifth duct 22, corresponding to the first duct 25, and a sixth duct 24, corresponding to the third duct 27, while FIG. 6 shows in the other head 2' a seventh duct 22', corresponding to the second duct 26, and an eighth duct 24', corresponding to the fourth duct 28.

The operation of the shuttle valve 13 is now illustrated with reference to FIGS. 1 and 3-6, starting from the position of the spool 134 as shown in FIG. 3*c*. The compressed air (or nitrogen), once it has entered the inlet duct 23, passes in the first duct 25 and hence, through the holes 140, in the duct 139 of the corresponding screw 135, then passing in the fifth duct 22 of the head 2 and thus arriving inside the bellow 31 pushing it within the pumping chamber 100 (a similar access 72 of the seventh duct 22' located on a cylindrical projection 21' is shown in FIG. 6*c*). In the final part of its stroke, the bellow 31 draws the seal cap (identical to the collar 34' housed in the other pumping chamber illustrated in FIG. 1) that opens access to the sixth duct 24 of the head 2, internal to the cylindrical projection of the latter (identical to the projection 21' of the head 2'; similar access 71 to the eighth duct 24' is shown in FIG. 6*c*). Simultaneously, due to the drag of the shaft 9 by the pumping bellow 31, the opposed bellow 31' is compressed and sucks fluid in the corresponding chamber from the pump inlet mouth 51 through the respective suction valve 10 (the two suction valves of the two chambers are also shown in FIG. 2); the compressed bellow 31' also pushes the respective seal collar 34' against its seat (internal to the projection 21'). The air flow returns in the cylinder 133, through the sixth duct 24 and the third duct 27, put in communication with each other by the corresponding fastening screw 135 (see FIG. 5). The air entering the cylinder 133 pushes the end 138 and consequently the spool 134 upwards, thus closing the access to the first duct 25 and opening access to the second duct 26 that supplies the chamber of the bellow 31'; finally, the air exits from the outlet duct 30 (see FIG. 3). Now, the air entering the inlet duct 23 is forced to pass through the second duct 26 and it is thus directed towards the pumping bellow 31' and the cycle repeats until the compressed air returns in the cylinder 133 pushing the end 138' and exiting from the outlet duct 29 of the shuttle valve 13. In particular, the fluid previously sucked in the corresponding pumping chamber is now pushed by the bellow 31' towards the pump outlet mouth 52 through the respective delivery valve 8 (the two delivery valves of the two chambers are also shown in FIG. 2). In particular, the annular ends 40 and 40' of the pumping bellows 31 and 31' which face the heads 2 and 2' ensure the seal between the outer cylindrical surfaces of the bellows 31 and 31', which face the inside of the pumping chambers, and hence the fluid to be pumped, and the inner cylindrical surfaces of the bellows 31 and 31', which face the heads 2 and 2', guaranteeing that the fluid subject to pumping passes towards neither the heads 2 and 2' nor the duct circuit of the pressurized air.

In order to avoid any air loss from the ducts internal to the shuttle valve 13 and to the heads 2 and 2', assembly of the shuttle valve 13 is carried out after both heads 2 and 2' have been positioned and centered so as to ensure alignment of the respective ducts.

Making reference to FIG. 1, screwing of the heads 2 and 2' is carried out so as to align the side wall 41 of the octagon, where holes 42 and 43 for accessing the fifth and sixth ducts 22 and 24, respectively, are present, in a position perfectly parallel to the corresponding side wall 61 of the pump and thus in such a way to offer to the lower surface 140 (see FIG. 3*b*) of the shuttle valve 13 to assemble a perfectly flat supporting surface. Teflon ORs may be placed between the shuttle valve 13 and the heads 2 and 2' for improving seal and alignment of the shuttle valve 13.

Making reference to FIGS. 1, 5 and 6, in order to ensure a perfect centering of the heads 2 and 2', each one of these is preferably provided with a through hole 35 and 35' corresponding to a respective hole present on the pump wall onto which the head rests (only the hole 36 corresponding to the hole 35 of the head 2 is visible in FIG. 1), so that a centering pin may be stably and removably inserted, preferably restrained, therein (pin 37 related to the holes 35 and 36 is visible in FIG. 5) only upon reaching the correct assembly mutual position of the coverage head and pump.

Figure 7:
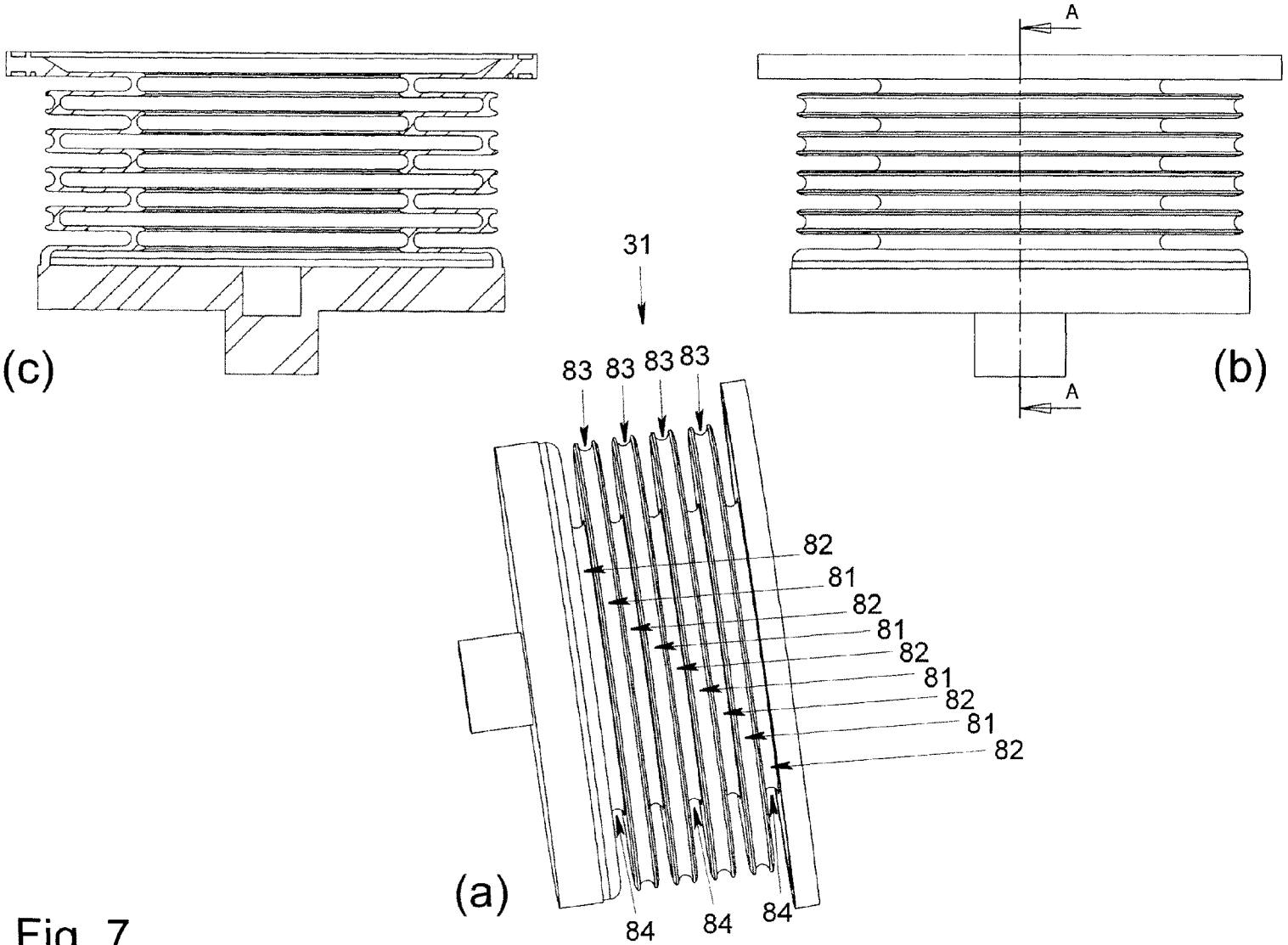
FIG. 7 shows a perspective view (a), a side view (b) and a sectional view (c) along line A-A of FIG. 7(*b*) of a flexible bellow of the pump of FIG. 1.

With reference to FIG. 7, it may be observed that each pumping bellow (in FIG. 7 reference numerals refer to the pumping bellow 31, but it should be understood that the bellow 31' is identical) comprises a plurality of outer coils 81, separated by a plurality of inner coils 82, wherein the lateral profile of both outer and inner coils 81 and 82 presents concave grooves 83 and 84, respectively. This ensures greater resistance and longer life along with a higher elasticity to the pumping bellows.

With reference to FIGS. 1 and 2, it may be observed that the preferred embodiment of the pump according to the invention includes a pair of delivery ball valves, each one comprising a case 8 housing a ball 7, housed in respective upper seats 4 of the pump body 1, in correspondence with the outlet mouth 52, closed by taps 5.

An important aspect of the present invention is the use of two compensating bellows 6, interposed between the ball 7 of each delivery valve and the respective tap 5, in order to compensate variations of rate occurring in the pump when motion in the chambers is reversed. Such compensating bellows 6 thus allow a constant delivery rate to be obtained, avoiding the use of conventional shot compensators assembled after the pumping system. This also avoids the possibility of producing particles which could be potentially generated along the section going from the delivery valves up to the external compensator.

Figure 8A:
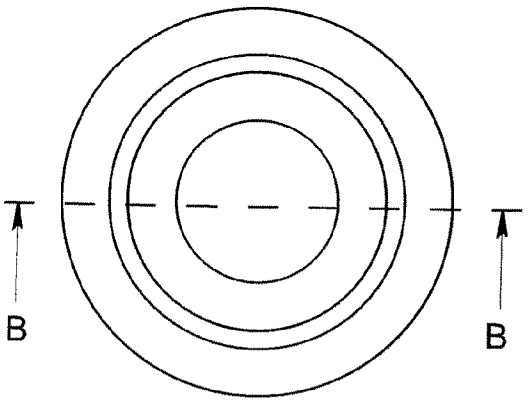
FIG. 8 shows a top plan view (a) and a perspective view (b) of the section along line B-B of FIG. 8(*a*) of a compensating bellow of the pump of FIG. 1.
Figure 8B:
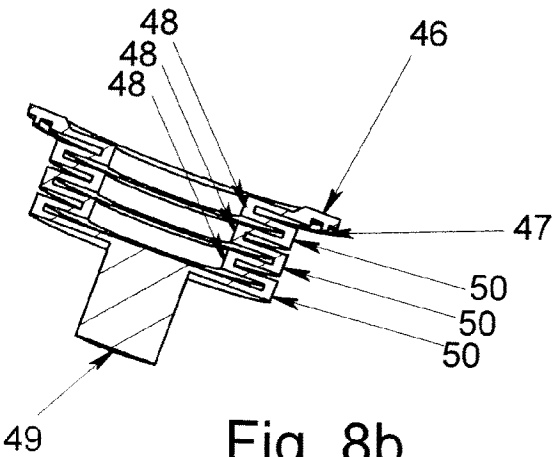

With reference to FIG. 8, it may be observed that the particular section of the compensating bellow 6 allows to control the flow through the delivery ducts. In particular, as shown in FIG. 8*b*, . the upper coil 46 of the compensating bellow 6 gets in contact with the lower surface of the tap 5 that, fastened, ensures the seal of the bellow 6. Moreover, in order to guarantee a better seal, the upper coil 46 comprises downwards, where the compensating bellow 6 gets in contact with the pump body 1, a projecting border 47 engaging with a corresponding groove made in the pump body 1. The lower nose 49 of the compensating bellow 6, during pump operation, gets in contact with the ball 7 that, pushed by the pressure exerted by the liquid exiting from a pumping chamber, releases its energy on the compensating bellow 6 that, acting as a spring, absorbs the impact and pressure peaks. To this end, it may be observed that both inner and outer coils 48 and 50 have a squared profile.

Still with reference to FIGS. 1 and 2, it may be observed that the preferred embodiment of the pump according to the invention includes a pair of suction ball valves, each comprising a case 10 housing a ball 7 and closed by a cover 11, housed in respective lower seats of the pump body 1, in correspondence of the inlet mouth 51, closed by taps 12.

Figure 9:
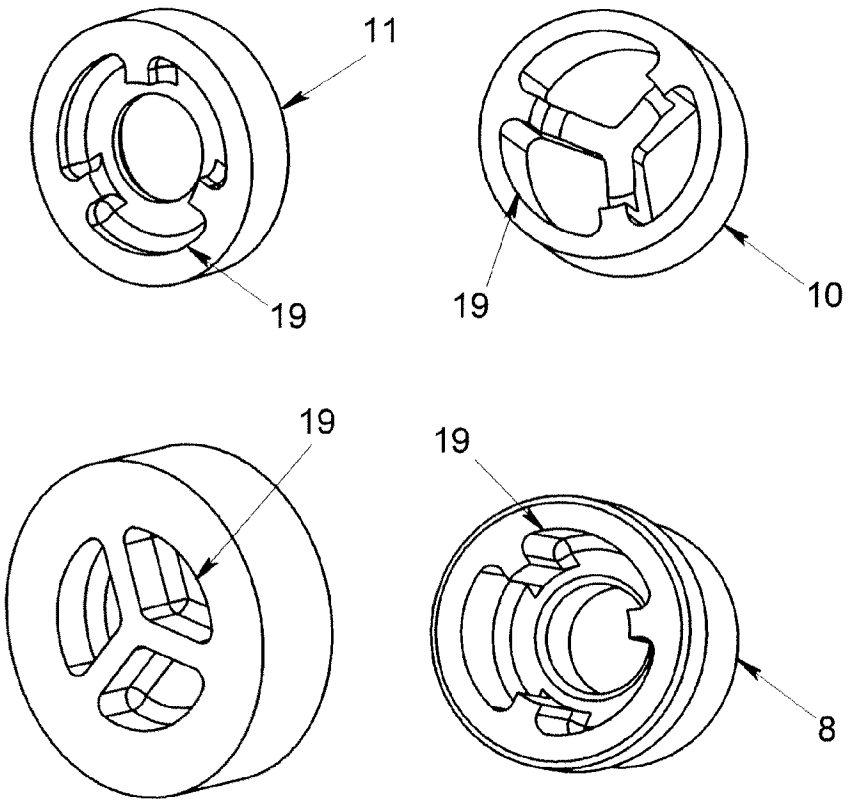
FIG. 9 shows a perspective view of some components of the delivery and suction valves of the pump of FIG. 1.

With particular reference to FIG. 9, it may be observed that the cases 8 of the delivery valves and the cases 10 of the suction valves are shaped so as to guide the movement of the respective balls 7 for allowing a fluid passage that is smooth and without turbulence. Moreover, in order to aid its assembly and disassembly, elements 5 and 8 of the delivery valves and elements 10 and 11 of the suction valves are shaped so as to be provided with three pockets 19 allowing a corresponding tool (not shown), provided with three corresponding projections, to perfectly insert therein and engage with them.

Still with reference to FIG. 1, it may be observed that the preferred embodiment of the pump according to the invention is provided with a handle comprising a bar 91, laterally fastenable to two supports 92 in turn fastenable to two respective base plates 93. In particular, the plates 93 (and possibly the lower part of the side supports 92) may be reliably inserted in and easily extracted from corresponding grooves 94 of the pump body 1. This makes the handle easily removable from the pump body 1, simultaneously allowing an operator to easily and safely move the pump, even in presence of limited and cramped space, also allowing not to touch pump outer components for avoiding contaminations, especially for "ultra-pure" applications of the pump.

Figure 10:
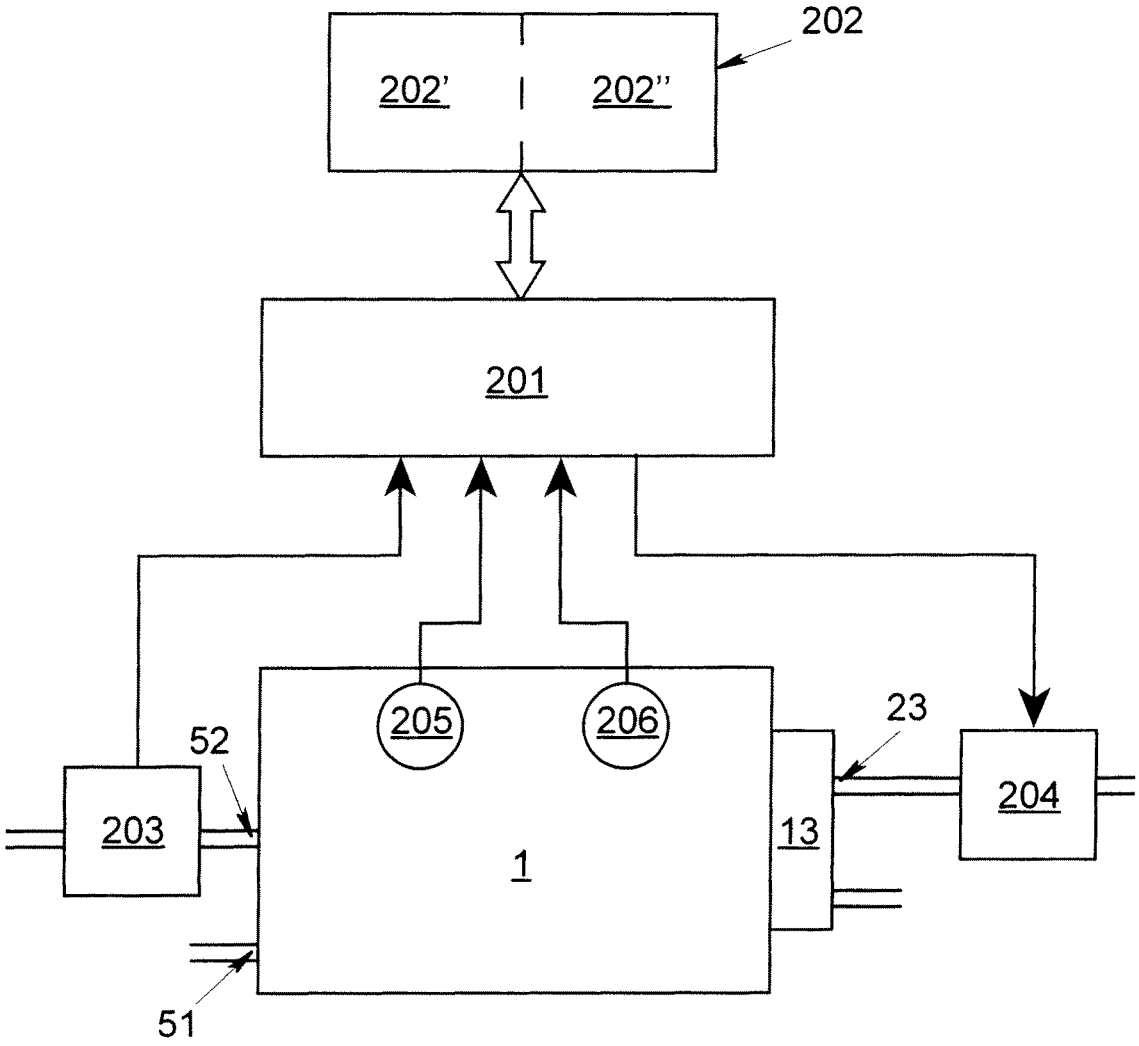
FIG. 10 shows a schematic block diagram of the electronics of the pump of FIG. 1.

FIG. 10 schematically shows the control and monitoring system of the preferred embodiment of the pump. Such system comprises a flow sensor 203 mounted on a pump delivery pipe, i.e. after its outlet mouth 52. The detected flow value is transmitted to a control electronic unit 201, preferably comprising a PLC (Programmable Logic Controller), that sends a control signal to an electronic pressure regulator 204 mounted on the compressed air delivery pipe before the duct 23 of the shuttle valve 13. The electronic unit 201 is connected to an interface unit 202, comprising a display 202' and a keyboard 202", preferably integrated into a touch screen.

Such system offers the advantage that the operator's task is reduced to set the desired flow value through the interface unit 202, depending on which the electronic unit 201 automatically controls the electronic regulator 204 for maintaining the air pressure necessary to decrease or increase the pump speed.

The control and monitoring system is also capable to monitor pump operation, in particular detecting the number of operation cycles and any possible break of membranes or bellows due to wear.

In particular, the number of cycles is calculated through suitable optical fiber sensors inserted in correspondence with the accesses of the ducts 24 and 24' of the head 2 for delivering compressed air in the pumping chambers.

In particular, the number of cycles is detected through suitable optical fibers sensors 205 connected to the electronic unit 201. Such sensors 205 are inserted, for instance, in correspondence with the holes for access to ducts 22 and 22' (hole 72 of the head 2' is shown in FIG. 6*c*).

Such sensors detects both contact and departure of the bellow 31 or 31' and, consequently, the related number of shots and/or cycles. In this way, the electronic unit 201 is capable to determine, store and present on the display 202" data like:

- number of cycles made by the bellows;
- historical archive of cycles in time;
- programming, preventive maintenance, replacement of bellow kits and complete suction and delivery valve kit;
- historical records of the performed cycles as a function of the pumped fluid;
- alarm detection upon reaching duration and replacement limit.

These sensors also carry out a mechanical control allowing to test pump efficiency checking the correct alternate opening and closing of the compressed air ducts. An improper operation of these would affect the movement of the spool 134 of the shuttle valve 13 generating the malfunction of the whole pump.

The pump is further provided with sensors 206 for detecting losses in the compressed air circuit, still connected to the electronic unit 201. Such sensors 206 sense the presence of fluid within the air duct due to a flaw of the bellows 31 and 31'. These sensors 206 are preferably optical fiber ones, and they are inserted within holes made on the cylindrical projection of each one of the heads 2 and 2' (projection 21' of the head 2' is shown in FIGS. 1 and 6*c*).

Other air and/or fluid loss sensors may be installed within the fluid and/or compressed air ducts.

Further sensors may be installed for detecting, during pump operation, main flow parameters, such as rate, pressure, temperature.

All the sensors used in the pump are preferably capable to operate in presence of acids and/or solvents and at temperatures up to 220° C.

In particular, the electronic unit 201 is provided with a software for controlling the pump. The software allows to control pump power up and power down, to execute operations for controlling pump state, to alert in case of detection of failures or malfunctions, and finally it allows to manage maintenance times scheduling pauses for controlling components and for their possible replacement.

The interface unit 202, preferably a touch-screen showing one or more graphical interfaces with which an operator may directly interact, allows configuration and display, in particular, of one or more of the following parameters:

- pump operation time as detected by the bellow movement;
- historical archive of the bellow shots;
- management of the scheduled preventive maintenance;
- signaling due to excess of the settable time limit for maintenance;
- signaling due to excess of the fixed time limit for the pump life;
- display of the pump state;
- display of alarm due to presence of acid vapors and solvents at the pump discharge pipe;
- display of alarm due to lack of pump bellow movement; and
- historical archive of the alarms.

Figure 11:
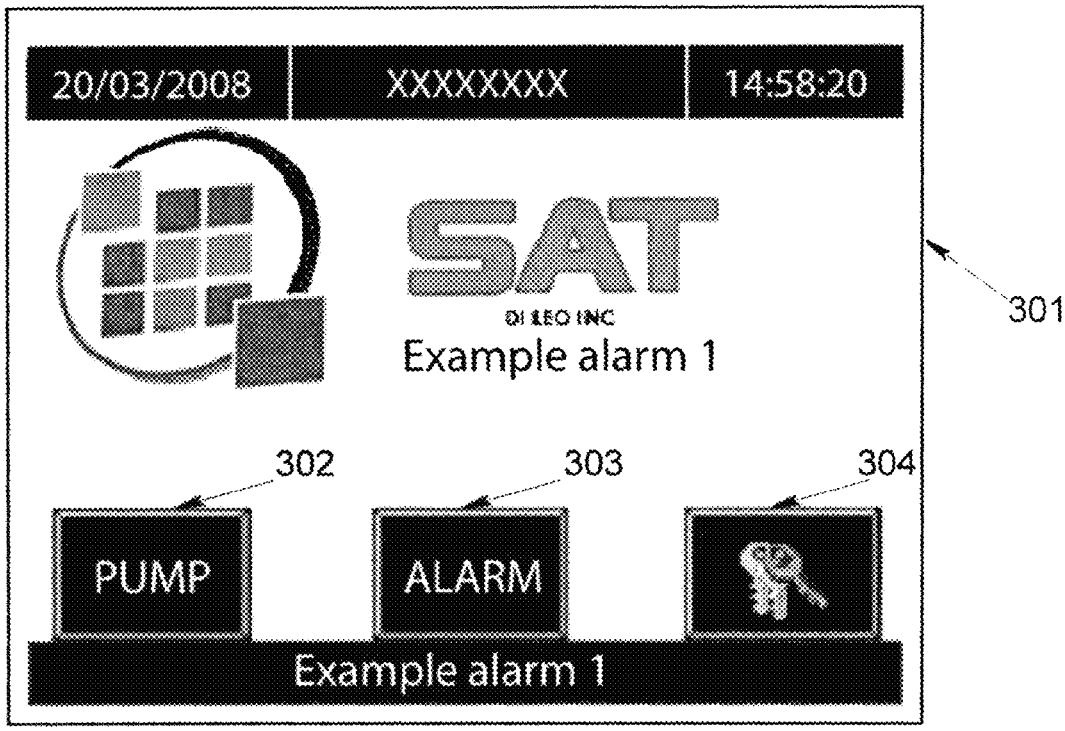
FIGS. 11-15 show some graphical interfaces displayed by the software executed by the electronics of FIG. 10.

As shown in FIG. 11, upon powering up the equipment, the touch screen 202 shows an initial access page 301 comprising three selectable graphical buttons 302, 303, and 304.

Through the selection of the button 304, access is gained to an access managing page, wherein it is possible to choose a level with which entering to operate on the pump. Levels are preferably three: OPERATOR, ENGINEER, and SERVICE. Preferably, for entering each level it is necessary to input a password through a screen graphical keyboard. At each level, the operator is enabled to a different set of functions.

Figure 12:
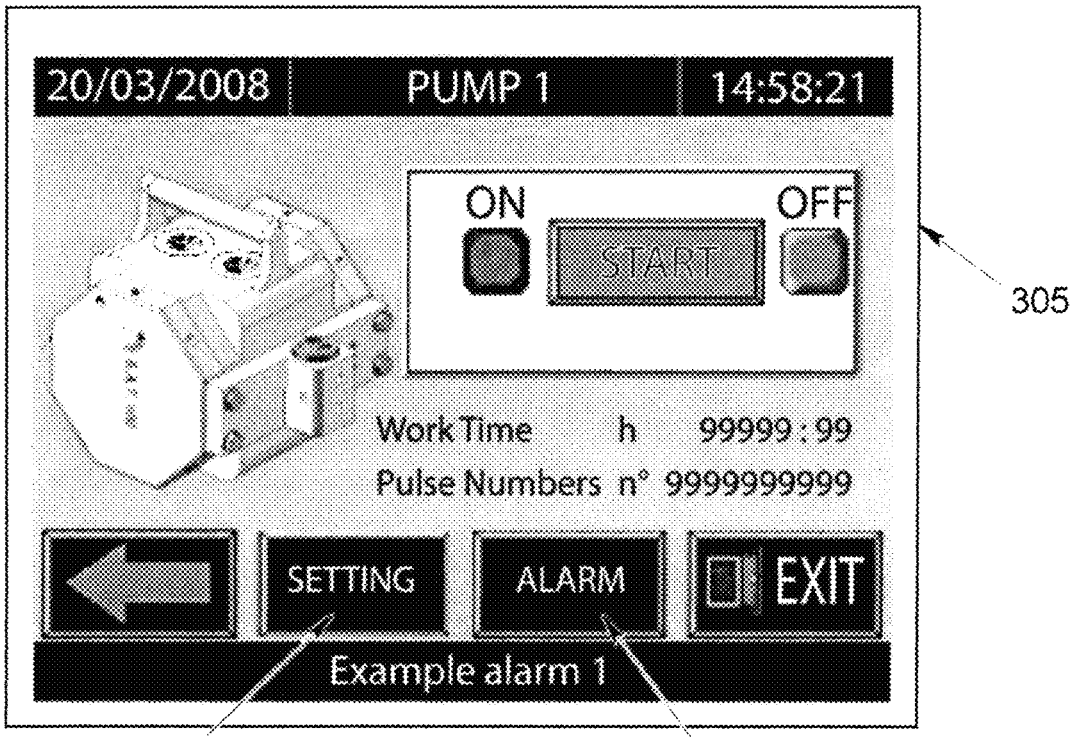

Through the selection of the button 302, access is gained to a pump control graphical interface 305 shown in FIG. 12. The page 305 is the main page of the pump, from which it is possible to control the pump power up and the power down, through respective buttons 306 and 307. The same page 305 displays whole work time (in the Work Time field) and number of total pulses (in the Pulse Numbers field) carried out by the pump. Moreover, it is possible to access a page related to maintenance settings, by selecting a graphical button SETTING 308, and a page related to detection of the pump malfunctions, by selecting a graphical button ALARM 309. Preferably, the software does not allow an operator enabled with OPERATOR level to access the page SETTING and it allows only display of the alarms in the ALARM page without capability of intervention for their removal.

Upon each command of pump start, that may be carried out by the operator by selecting the graphical button START, a further window appears on the screen where pump operation parameters may be set and an identifier name may be input which name serves to go back (as time in terms of both hours and date) to all the events and alarms for that type of recipe or process. Upon each stop of the pump, also selectable by the operator in the graphical window opened at the beginning, a file with all related data is closed and, upon the next start, another one is opened.

During pump operation, components are subject to wear in a different manner and hence the pump must be stopped for replacing worn parts. It is important to be capable to provide for a scheduling for carrying out maintenance through a maintenance setting.

Figure 13:
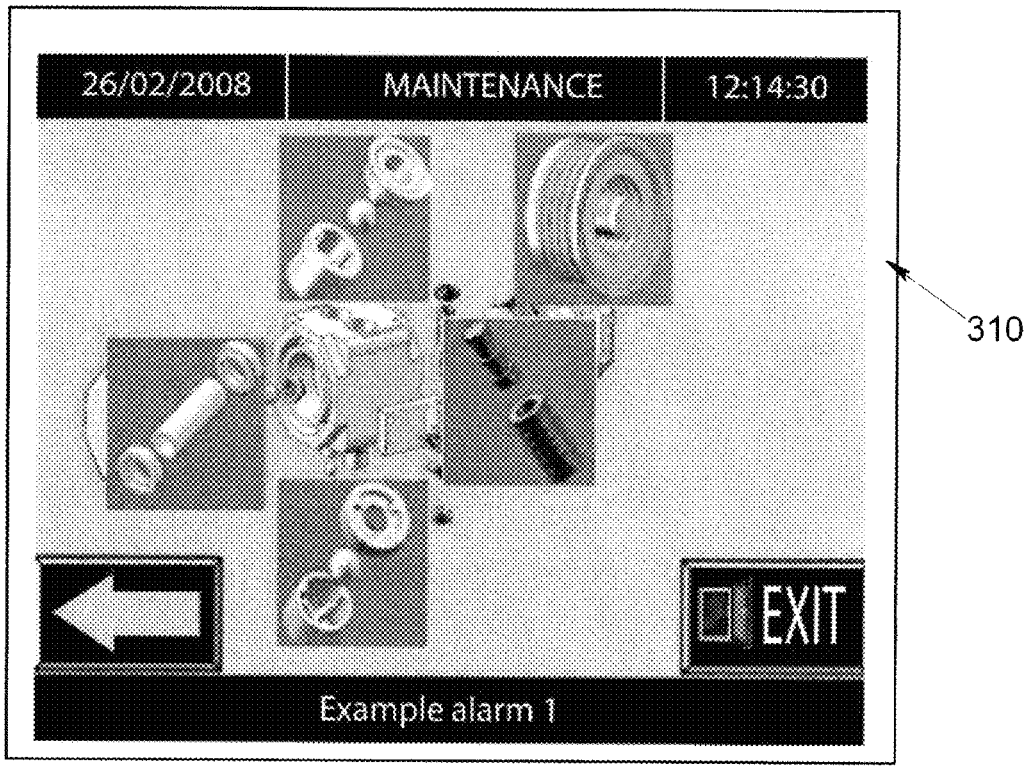

Components subject to wear or break are grouped in kit, such as, for instance: a suction valve kit, a delivery valve kit, and a bellow kit. In particular, parameters which have to be monitored for controlling component life time comprise: the type of employed fluid and related temperatures, the number of pumping cycles referred to time, and the pump operating pressure. Each time that the number of cycles or operation hours as set for each kit is reached, page 310 is displayed as shown in FIG. 13 wherein an icon blinks which represents the only kit for which (routine or extraordinary) maintenance is needed.

Figure 14:
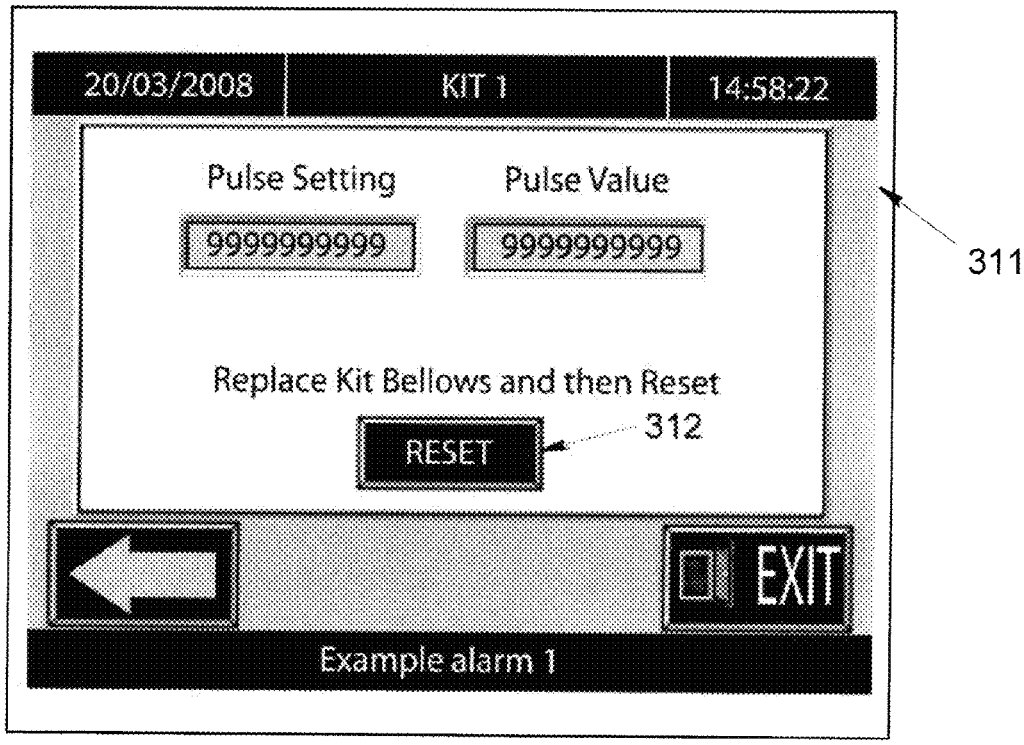

Management of maintenance is carried out on a window related to each kit, which window is accessible by selecting the corresponding icon. FIG. 14 shows the graphical window 311 for managing maintenance of the bellow kit, that displays the current value of shots (in the Pulse Value field) and the shot value as set for maintenance (Pulse Setting field). When the Pulse Value reaches the Pulse Setting, the program (acoustically and/or graphically) signals to the operator that it is necessary to replace the kit. Once the current value of shots has been reset by selecting the graphical button 312, the corresponding bellow kit replacement alarm is automatically removed. This procedure is identical for all the available kits.

Figure 15:
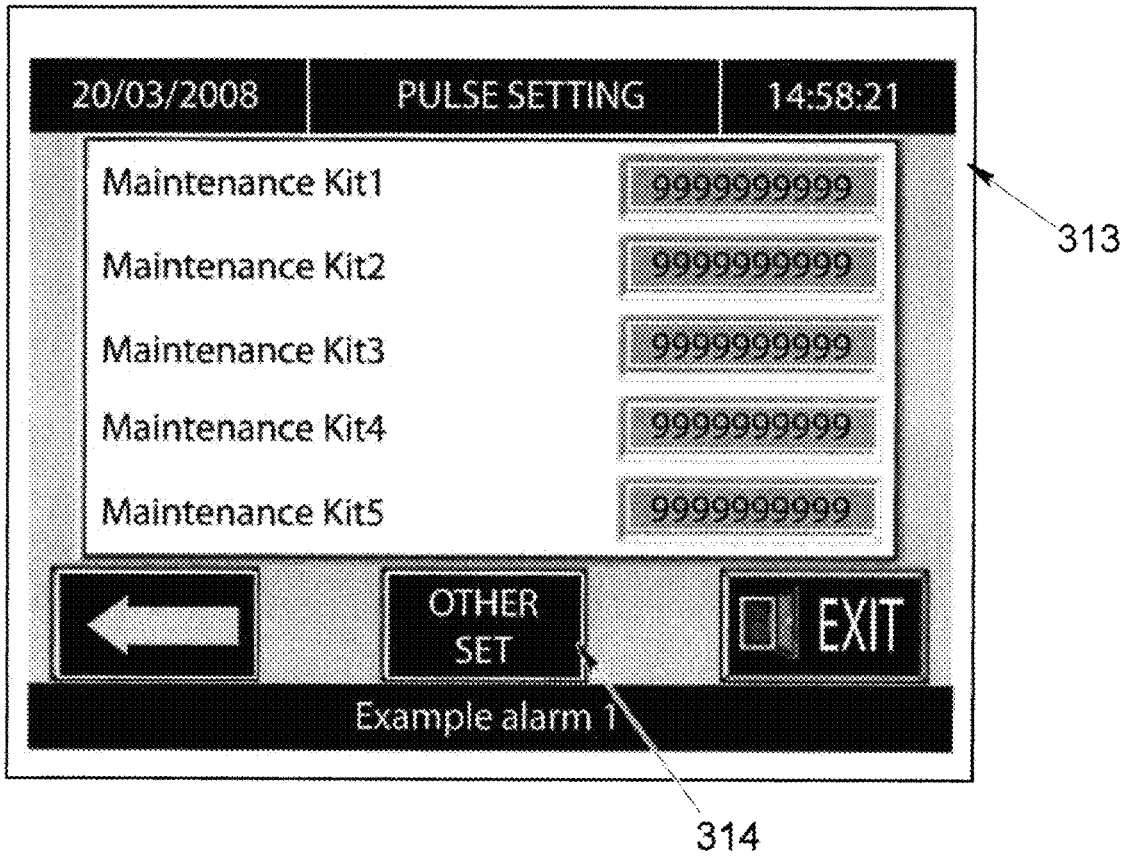

Through the selection of the button 308 of the page 305 access is gained to a graphical interface 313 related to maintenance settings as shown in FIG. 15. On this page 313 an operator may modify maintenance values for each pump kit. Upon reaching such values, the software shows the graphical interface of FIG. 13. By selecting the graphical button OTHER SET 314, the total time of pump operation is displayed.

Through the selection of the button 309 of the page 305 access is gained to a graphical interface related to detection of pump malfunctions, that displays the machine state. In particular, all the alarms present in the system are displayed with time passed from the event and the alarm state. Through scrolling buttons it is possible to display the whole alarm list and to reset only the alarms which are under restoration condition, while those still persisting remain displayed in the list. The alarm page automatically appears when an alarm occurs.

Figure 16:
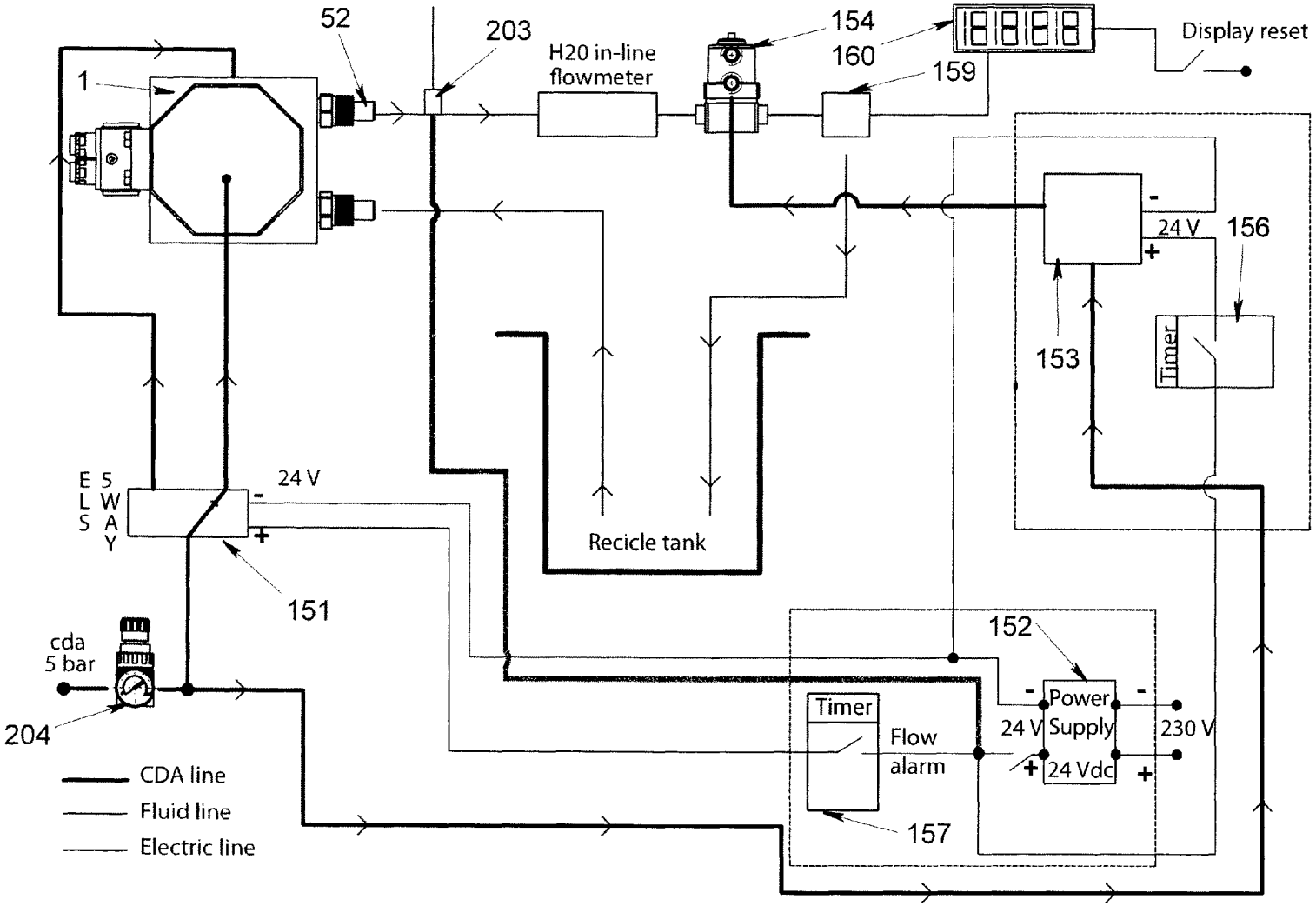
FIG. 16 shows a schematic block diagram of a second preferred embodiment of the pump according to the invention.

With reference to FIG. 16, it may be observed that a second preferred embodiment of the pump according to the invention comprises, instead of the pneumatically operated shuttle valve, an electro-pneumatic system for controlling the pump 1 comprising an electric shuttle 151.

In particular, the controlling system comprises a power supply 152 supplying an electric valve 153 controlling the opening and closing of a pneumatically operated valve 154 installed on the delivery pipeline of the pump 1 (after the outlet mouth of the latter), after a flow sensor, preferably coinciding with the sensor 203 shown in FIG. 10). A timer 156 determines opening and closing times of the electric valve 153 interrupting the air flow towards the pneumatically operated valve 154. The timer 156 is preferably provided with a touch-screen display (not shown in the Figure) through which an operator may set its operation.

The heart of the system for controlling the pump 1 is formed by the power supply 152, that is connected to a second timer 157 in turn connected to the five-way coil electric shuttle 151. The electric shuttle 151 is directly connected to the compressed air pneumatic circuit of the pump 1, that controls its reciprocating operation. Regulation of the inlet air pressure is carried out before the electric shuttle 151 through a regulator, preferably coinciding with the electronic regulator 204 shown in FIG. 10. Once that the value of pressure at the inlet of the electric shuttle 151, upon pump power up, the timer 157, that is previously set, begins to switch its state according to a sequential cycle that is settable from a touch-screen display of the timer 157. The timer 157 supplies the coil of the electric shuttle 151 alternatively exchanging the compressed air between its two outlets, connected to two respective pumping chambers of the pump wherein the bellows are housed. The air that is directly and reciprocally sent to the pumping chambers of the pump 1 allows the reciprocating operation of the latter.

A flow sensor 203 is installed at the outlet mouth 52 of the pump 1, that is capable to emit an alarm signal, monitoring the operation of the pump 1. At the moment when the pneumatically operated valve 154 comes into operation, thus stopping the delivery flow coming from the outlet mouth 52, the sensor 203 senses a pressure increase in the delivery duct of the pump 1 and it automatically disconnects the second timer 157 by opening the related circuit and consequently the system for controlling the pump 1 stops and a both acoustic and visual alarm signal is activated.

A meter 159 for monitoring the effective fluid consumption is installed on the delivery pipeline of the pump 1, after the pneumatically operated valve 154. A touch-screen display 160 permits to display the value detected by the meter 159 that may be reset through the same display 160.

The pump 1 has been developed in order to make the assembling and disassembling operations as simple as possible, e.g. being aided by the use of a single tool for disassembly. In fact, apart from the heads (2 and 2' of FIG. 1), all the disassemblable components related to the fluid delivery and suction valves are disassembled with a single tool thanks to the identical shape of pockets which have been suitably conceived and made. Moreover, many components, like, for instance, the bellows 31 and 31', the compensating bellows 6, the suction valve case, are not clamped within their respective seats, instead they are fixed by exploiting the fastening of other elements and/or they are held in position thanks to grooves made on the same components.

Also, the high resistance of the connections of the pump makes the latter suitable to be wholly produced in corrosion resistant materials, making it suitable for applications in semiconductor industry.

The pump is preferably made of corrosion resistant materials, such as ultrapure thermoplastic materials and/or organic polymers and/or fluoridated polymers.

No metal part is present in the pump, and the fastening of the components is carried out through threads made on the same parts and no other connecting elements are present, this making the system more reliable. The corrosion resistant materials of the pump comprise one or more materials selected from the group comprising or consisting of MFA, TFM, PP, Teflon PFA, pure Teflon, PEEK, PTFE, PVDF, and FEP.

The present invention has been described, by way of illustration and not by way of limitation, according to its preferred embodiments, but it should be understood that those skilled in the art can make variations and/or changes, without so departing from the related scope of protection.

The invention claimed is:

1. A pneumatically operated reciprocating pump comprising two opposed pumping chambers, in each one of which a respective flexible bellow slides between a compressed position and an expanded position, a slide of the two flexible bellows being controlled by shuttle means capable to alternatively let a gaseous fluid in one of the two chambers for expanding the respective flexible bellow, whereby when each one of the two flexible bellows assumes a threshold expanded position it interacts with mechanical means allowing the gaseous fluid to be discharged from the respective chamber, each one of the two flexible bellows having a front end in contact with a shaft that is alternatively pushed by one of the two flexible bellows thus compressing the other, each one of the two chambers being connected to at least one respective suction valve and to at least one respective delivery valve, wherein each delivery valve is provided with compensating elastic means capable to compensate variations of rate of fluid that is pumped by the respective chamber, wherein said shuttle means comprises a pneumatically operated shuttle valve comprising a shaped spool sliding between two limit positions within a perforated cylinder, which shuttle valve is connected, for each chamber, to one or more delivery ducts and to one or more ducts for respectively letting and discharging gaseous fluid in and from the respective chamber, the shuttle valve being capable to alternatively open and close the delivery ducts of the two chambers depending on the position of the spool, the spool being moved by the gaseous fluid coming from a chamber through the respective discharge ducts when the spool is in a position in which the spool opens the delivery ducts of the other chamber, and wherein, for each chamber, said one or more delivery ducts and said one or more discharge ducts are internal to the shuttle valve and to a head covering the respective chamber, the two heads being removably coupled to a pump body, the shuttle valve being fastened to the two heads through hollow screws provided with at least one duct capable to put at least one duct internal to the shuttle valve in communication with at least one duct of the respective head.

2. A pump according to claim 1, wherein said compensating elastic means comprises at least one compensating bellow.

3. A pump according to claim 2, wherein each compensating bellow comprises a plurality of outer coils, separated from each other by a plurality of inner coils, wherein the inner and outer coils have a squared side profile.

4. A pump according to claim 1, wherein each delivery valve is a ball valve.

5. A pump according to claim 4, wherein each delivery ball valve is housed in a respective seat of the pump closed by a tap, each delivery ball valve comprising a case housing a ball, the respective compensating bellow being interposed between the ball and the tap, so that, during pump operation, a front end of the compensating bellow gets in contact with the ball absorbing related impacts and pressure peaks exerted by the fluid pumped by the respective chamber.

6. A pump according to claim 1, wherein each suction valve is a ball valve.

7. A pump according to claim 6, wherein each suction ball valve is housed in a respective seat of the pump closed by a tap, each suction ball valve comprising a case housing a ball and being closed by a cover.

8. A pump according to claim 5, wherein each suction ball valve is housed in a respective seat of the pump closed by a tap, each suction ball valve comprising a case housing a ball and closed by a cover, wherein the case and the tap of each delivery ball valve and the case and the cover of each suction ball valve are shaped so as to be provided with three pockets.

9. A pump according to claim 1, wherein each one of the two flexible bellows comprises a plurality of outer coils, separated from each other by a plurality of inner coils, wherein the outer and inner coils have a lateral profile that presents concave grooves.

10. A pump according to claim 1, wherein each one of the two heads and the pump body are provided with mechanical means for mutual alignment.

11. A pump according to claim 10, wherein said mutual alignment mechanical means comprises, for each head, at least one centering pin insertable in a through hole of the respective head and in a corresponding hole of the pump body.

12. A pump according to claim 1, wherein said shuttle means comprises a control electronic means, that controls an electric shuttle connected, for each chamber, to one or more delivery ducts letting gaseous fluid in the respective chamber, the electric shuttle being capable to alternatively open and close the delivery ducts of the two chambers.

13. A pump according to claim 12, wherein the electric shuttle receives the gaseous fluid, that is to be alternatively let in the two chambers, from a pressure regulator.

14. A pump according to claim 12, wherein said control electronic means comprises at least one timer and a power supply.

15. A pump according to claim 12, wherein said control electronic means further controls a pneumatically operated valve, installed on a delivery pipeline of the pump after a flow sensor capable to sense the pressure of the fluid pumped in the delivery pipeline and to send a related sensing signal to said control electronic means.

16. A pump according to claim 15, wherein said control electronic means comprises an electric valve controlling the pneumatically operated valve.

17. A pump according to claim 12, wherein the electric shuttle is a five-way coil electric shuttle with a power supply which is controlled by said control electronic means.

18. A pump according to claim 1, wherein the pump further comprises a control electronic unit that receives a signal indicative of the flow of the pumped fluid from a flow sensor mounted on a delivery pipeline of the pump, the control electronic unit controlling an electronic pressure regulator mounted on the compressed air delivery pipeline before said shuttle means depending on a predetermined flow value of the pumped fluid.

19. A pump according to claim 18, wherein the control electronic unit comprises a Programmable Logic Controller or PLC.

20. A pump according to claim 18, wherein the control electronic unit is connected to interface means.

21. A pump according to claim 20, wherein said interface means comprises a display and a keyboard.

22. A pump according to claim 18, wherein said predetermined flow value of the pumped fluid is adjustable.

23. A pump according to claim 18, wherein the control electronic unit is connected, for at least one flexible bellow, to at least one first sensor internal to the pump capable to provide the control electronic unit with at least one detection signal when said at least one flexible bellow assumes a position within the respective chamber.

24. A pump according to claim 23, wherein the control electronic unit is capable to determine a number of cycles performed by the pump of said at least one detection signal.

25. A pump according to claim 24, wherein the control electronic unit is capable to program and signal interventions of preventive maintenance.

26. A pump according to claim 18, wherein the control electronic unit is connected to one or more second sensors for sensing losses in the gaseous fluid circuit, capable to provide the control electronic unit with at least one signal of detection of presence of pumped fluid.

27. A pump according to claim 18, wherein the electronic unit is connected to one or more third sensors capable to provide the control electronic unit with at least one signal of detection of rate and/or pressure and/or temperature of the pumped fluid.

28. A pump according to claim 1, wherein the pump further comprises a removable handle.

29. A pump according to claim 1, wherein the pump is made of a material resistant to corrosion and/or chemical etching.

30. A pump according to claim 21, wherein said display and said keyboard are integrated in a touch-screen display.

31. A pump according to claim 23, wherein said at least one first sensor is an optical fiber sensor.

32. A pump according to claim 24, wherein the control electronic unit is capable to store said number of cycles performed by the pump of said at least one detection signal.

33. A pump according to claim 26, wherein said one or more second sensors are optical fiber sensors.

34. A pump according to claim 29, wherein said material resistant to corrosion and/or chemical etching is a material comprising one or more materials selected from the group comprising ultrapure thermoplastic materials, organic polymers, and fluoridated polymers.

35. A pump according to claim 34, wherein said material resistant to corrosion and/or chemical etching is a material comprising one or more materials selected from the group comprising MFA, TFM, PP, Teflon PFA, pure Teflon, PEEK, PTFE, PVDF, and FEP.

36. A pneumatically operated reciprocating pump comprising two opposed pumping chambers, in each one of which a respective flexible bellow slides between a compressed position and an expanded position, a slide of the two flexible bellows being controlled by shuttle means capable to alternatively let a gaseous fluid in one of the two chambers for expanding the respective flexible bellow, whereby when each one of the two flexible bellows assumes a threshold expanded position it interacts with mechanical means allowing the gaseous fluid to be discharged from the respective chamber, each one of the two flexible bellows having a front end in contact with a shaft that is alternatively pushed by one of the two flexible bellows thus compressing the other, each one of the two chambers being connected to at least one respective suction valve and to at least one respective delivery valve, wherein each delivery valve is provided with compensating elastic means capable to compensate variations of rate of fluid that is pumped by the respective chamber, wherein the pump further comprises a control electronic unit that receives a signal indicative of the flow of the pumped fluid from a flow sensor mounted on a delivery pipeline of the pump, the control electronic unit controlling an electronic pressure regulator mounted on the compressed air delivery pipeline before said shuttle means depending on a predetermined flow value of the pumped fluid, and wherein the control electronic unit is connected, for at least one flexible bellow, to at least one first sensor internal to the pump capable to provide the control electronic unit with at least one detection signal when said at least one flexible bellow assumes a position within the respective chamber.

37. A pump according to claim 36, wherein said at least one first sensor is an optical fiber sensor.

38. A pump according to claim 36, wherein the control electronic unit is capable to determine a number of cycles performed by the pump of said at least one detection signal.

39. A pump according to claim 38, wherein the control electronic unit is capable to store a number of cycles performed by the pump of said at least one detection signal.

40. A pump according to claim 38, wherein the control electronic unit is capable to program and signal interventions of preventive maintenance.

41. A pneumatically operated reciprocating pump comprising two opposed pumping chambers, in each one of which a respective flexible bellow slides between a compressed position and an expanded position, a slide of the two flexible bellows being controlled by shuttle means capable to alternatively let a gaseous fluid in one of the two chambers for expanding the respective flexible bellow, whereby when each one of the two flexible bellows assumes a threshold expanded position it interacts with mechanical means allowing the gaseous fluid to be discharged from the respective chamber, each one of the two flexible bellows having a front end in contact with a shaft that is alternatively pushed by one of the two flexible bellows thus compressing the other, each one of the two chambers being connected to at least one respective suction valve and to at least one respective delivery valve, wherein each delivery valve is provided with compensating elastic means capable to compensate variations of rate of fluid that is pumped by the respective chamber, wherein the pump further comprises a control electronic unit that receives a signal indicative of the flow of the pumped fluid from a flow sensor mounted on a delivery pipeline of the pump, the control electronic unit controlling an electronic pressure regulator mounted on the compressed air delivery pipeline before said shuttle means depending on a predetermined flow value of the pumped fluid, and wherein the control electronic unit is connected to one or more second sensors for sensing losses in the gaseous fluid circuit, capable to provide the control electronic unit with at least one signal of detection of presence of pumped fluid.

42. A pump according to claim 41, wherein said one or more second sensors are optical fiber sensors.

43. A pump according to claim 41, wherein the electronic unit is connected to one or more third sensors capable to provide the control electronic unit with at least one signal of detection of rate and/or pressure and/or temperature of the pumped fluid.

* * * * *